United States Patent [19]

Starvaski et al.

[11] 4,411,394

[45] Oct. 25, 1983

[54] POURING REEL

[75] Inventors: Raymond R. Starvaski, Worcester; Alfred R. Leger, Grafton, both of Mass.

[73] Assignee: Morgan Construction Company, Worcester, Mass.

[21] Appl. No.: 299,158

[22] Filed: Sep. 3, 1981

[51] Int. Cl.[3] ..... B21C 47/30

[52] U.S. Cl. ..... 242/83; 242/110

[58] Field of Search ..... 242/83, 84, 81, 82, 242/110, 110.1, 110.2

[56] References Cited

U.S. PATENT DOCUMENTS

| | | | |
|---|---|---|---|
| 2,135,913 | 11/1938 | Ralston et al. | 242/110 X |
| 3,014,577 | 12/1961 | Bruestle | 242/83 X |
| 3,020,000 | 2/1962 | Morgan | 242/81 |
| 3,926,382 | 12/1975 | Sievrin et al. | 242/81 X |

FOREIGN PATENT DOCUMENTS

| | | | |
|---|---|---|---|
| 1499134 | 11/1969 | Fed. Rep. of Germany | 242/83 |

*Primary Examiner*—John M. Jillions

*Attorney, Agent, or Firm*—Thompson, Birch

[57] ABSTRACT

A pouring reel has a rotatable tube with a bottom and an upstanding cylindrical side wall open at the top. Pin members are arranged in a circular row concentrically within the side wall. The pin members are pivotally adjustable between vertical positions cooperating with the tub side wall to define an annular coil forming chamber, and inoperative positions inclined inwardly from the side wall. Pivotal adjustment of the pin members from their inoperative to their operative positions is achieved by inserting a carrier into the tub. The carrier has a base which extends across and forms the bottom of the coil forming chamber, and a central core which carries contact membrs arranged to urge the pin members into their operative positions.

11 Claims, 4 Drawing Figures

POURING REEL

BACKGROUND OF THE INVENTION

This invention relates to pouring reels for rolling mills.

U.S. Pat. No. 3,020,000 discloses one type of conventional pouring reel where the mill product is gathered into a coil by being directed into an annular chamber formed between inner and outer concentric circular rows of rotating pins. A completed coil is stripped from the reel by raising the coil base plate above the pins. This type of apparatus has several drawbacks. First, when the coil is stripped from the reel, it is no longer radially confined or axially supported, and thus has a tendency to deform or topple over. Secondly, the coil has a tendency to shrink around the inner pins during the coiling operation. This is due to the fact that during coiling, the product is undergoing cooling from its elevated rolling temperature. This makes it difficult to strip the coil from the inner pins, and sometimes results in the inner coil rings being scratched.

A later pouring reel design is shown in U.S. Pat. No. 3,926,382. Here, the coil is formed around an inner core protruding vertically from a rotatable base plate. During the stripping operation, both the base plate and core are elevated above the reel, thus providing the coil with continuing axial support. A boom-mounted device then surrounds the coil and transfers it to another location. This type of apparatus is relatively complicated, expensive, and still does not avoid the problems caused by the coil shrinking around the central core.

SUMMARY OF THE PRESENT INVENTION

A general object of the present invention is to provide an improved pouring reel which obviates the drawbacks noted above in a relatively simple and effective manner.

In a preferred embodiment of the invention to be hereinafter described in greater detail, the pouring reel has a rotatable tub with a bottom and an upstanding cylindrical side wall open at the top. Pin members are arranged in a circular row concentrically within the side wall. The pin members are pivotally adjustable between vertical positions cooperating with the tub side wall to define an annular coil forming chamber, and inoperative positions inclined inwardly from the side wall. Pivotal adjustment of the pin members from their inoperative to their operative positions is achieved by inserting a carrier into the tub. The carrier has a base which extends across and forms the bottom of the coil forming chamber, and a central core which carries contact members arranged to urge the pin members into their operative positions. During the coil forming operation, both the tub and carrier are mechanically interlocked and rotated in unison, and mill product is directed longitudinally into the coil forming chamber where it is gathered into an upstanding coil. At the end of the coil forming operation, the carrier is removed vertically from the tub with the coil resting on its base and being axially supported by its core. During vertical removal of the carrier, its contact members disengage themselves from the pin members, thereby permitting the later to pivot to their inoperative positions away from the inner coil diameter.

DETAILED DESCRIPTION OF PREFERRED EMBODIMENT

Figure 1:
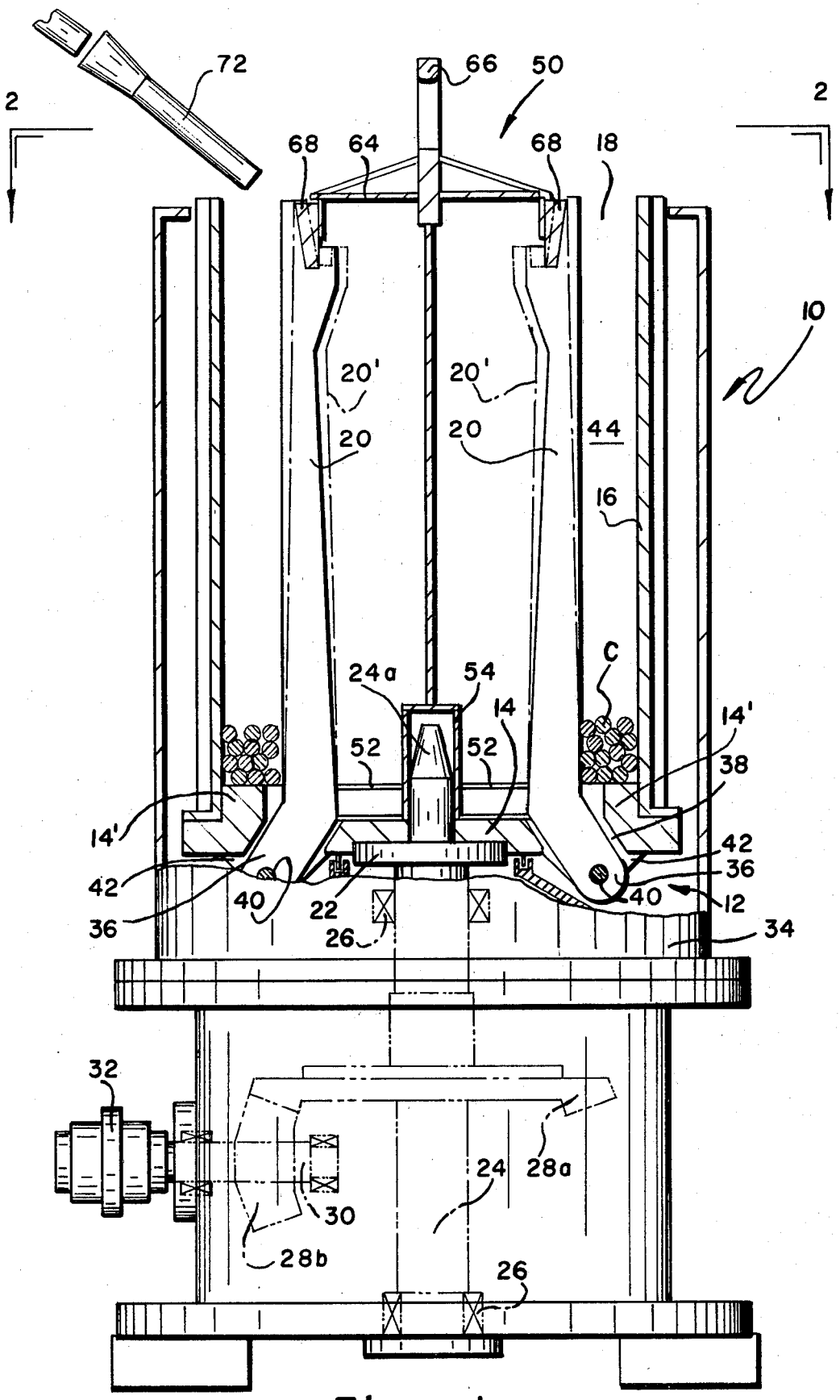
FIG. 1 is a view in side elevation, with portions broken away, showing a preferred embodiment of the present invention during the initial stages of a coil forming operation.
Figure 2:
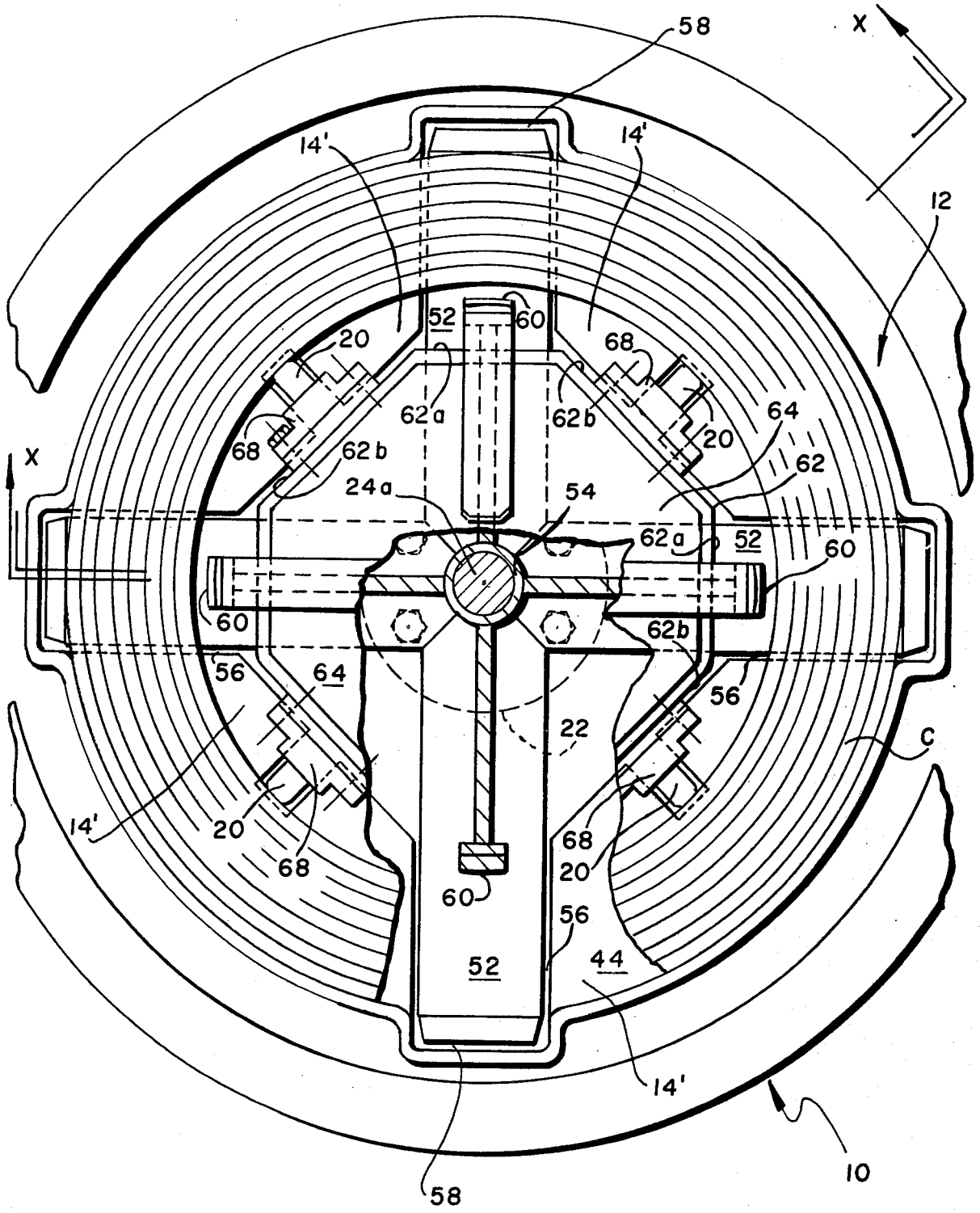
FIG. 2 is a horizontal plan view, again with portions broken away, taken along line 2—2 of FIG. 1.

Referring now to the drawings, there is shown at 10 a pouring reel for forming a longitudinally moving mill product, for example a round bar, into an upstanding cylindrical coil. By way of illustration, a typical coil forming operation might entail receiving ¾" bar at a mill delivery speed of 4000 f.p.m. and at a temperature of approximately 1700° F., and forming said bar into an upstanding coil weighing 6000 lbs., with an outer diameter of 54", an inner diameter of 39" and a height of approximately 75". It will be appreciated by those skilled in the art that coils of this size and weight are relatively unstable, and thus special precautions must be taken to avoid coil distortion during handling and transit.

The pouring reel 10 includes a rotatable tub 12 having a bottom 14, a cylindrical side wall 16 open at the top as at 18, and a circular row of pin members 20 arranged concentrically within the side wall. The tub bottom 14 is secured to the collar 22 of a vertical shaft 24 rotatably supported between bearings 26. The shaft 24 carries a driven bevel gear **28*a* in meshed relationship with a driving bevel gear 28*b* on horizontal shaft 30. Shaft 30 is connected by means of a coupling 32 to a drive motor (not shown). The rotatable tub 12 is disclosed within an outer fixed cylindrical housing 34 carrying conventional nozzles, piping, etc. (not shown) for applying cooling water to the external surface of the rotatable tub wall 16**.

The pin members 20 have angularly extending feet 36 which extend downwardly through openings 38 in the tub bottom 14. The feet 36 are connected as at 40 to brackets 42 on the underside of the tub bottom. The pin members are pivotal between substantially vertical operative positions as shown by the solid lines in FIG. 1, and inoperative inwardly inclined positions as shown by the dot-dash lines at 20' in FIG. 1. When operatively positioned, the pin members 20 cooperate with the tub side wall 16 to define an annular coil forming chamber 44.

A carrier generally indicated at 50 is removably inserted in the tub for rotation therewith. The carrier has a base in the form of feet 52 which extend radially from a central hollow hub 54. The hub 54 is received axially on the upper truncated conical end **24*a* of shaft 24, thus locating the carrier concentrically within the pouring reel tub. The feet 52 are received in radial grooves 56 in raised outer portions 14' of the tub bottom 14, and the ends of the feet protrude into vertical grooves 58 in the tub side wall 16**.

Figure 3:
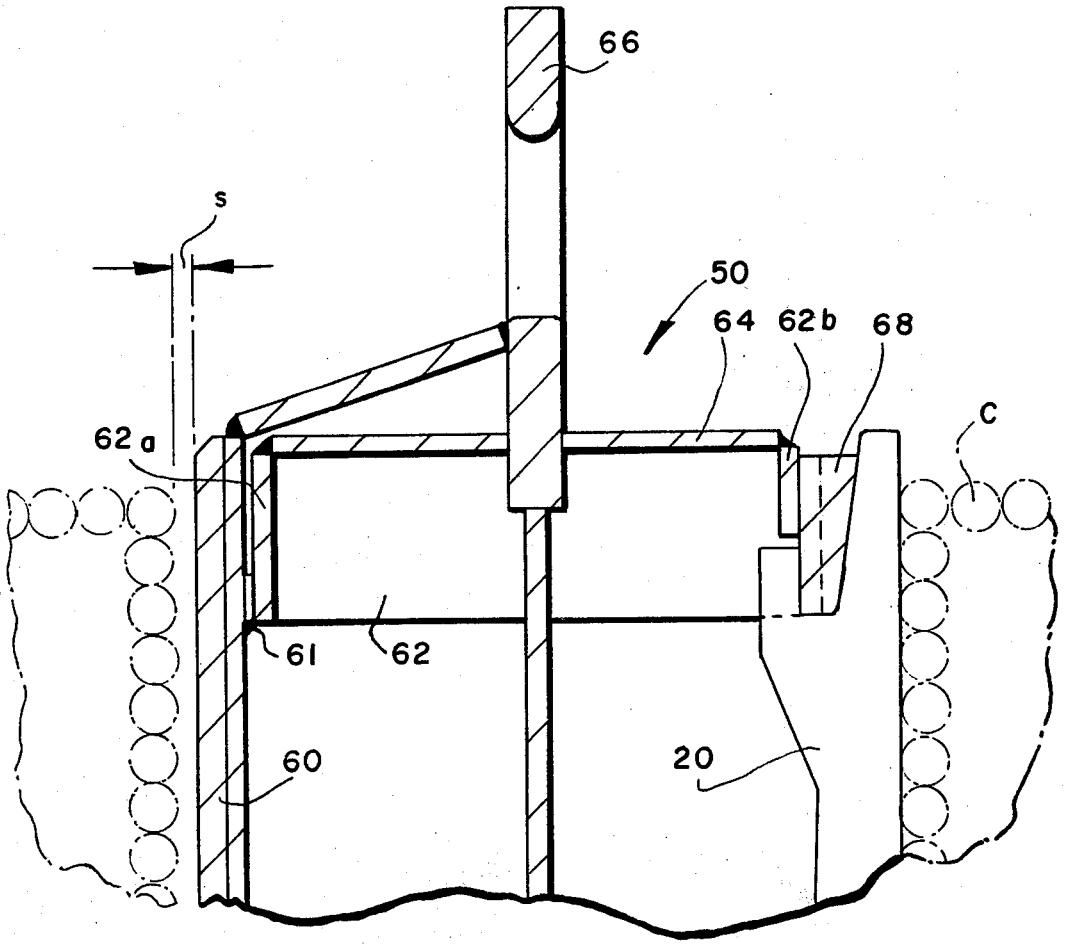
FIG. 3 is a sectional view of the upper end of the apparatus, on an enlarged scale taken along line X—X of FIG. 2, and showing the relationship of various components of the pouring reel and carrier at the end of a coil forming operation, preliminary to withdrawing the completed coil from the reel.

The carrier 50 is further provided with a central core protruding vertically from its base. The core comprises legs 60 which extend vertically from the feet 52 and which are connected as at 61 (see FIG. 3) to flat opposed faces 62*a* on an upper collar 62. Collar 62 is connected to a top plate 64 above which protrudes a lifting eye 66.

Figure 4:
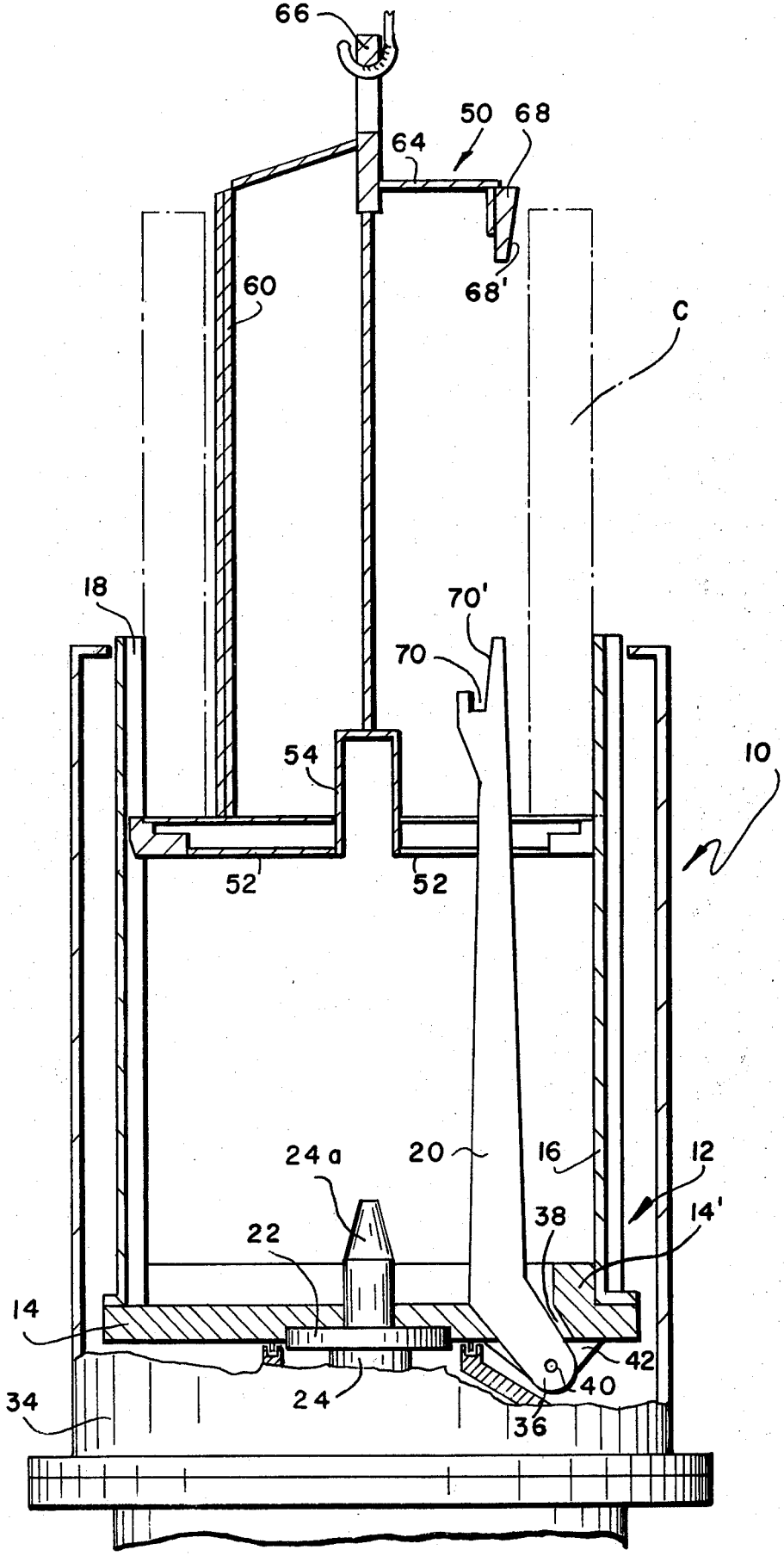
FIG. 4 is a side view, with portions broken away along line X—X of FIG. 2, showing the coil and carrier in the process of being removed vertically from the pouring reel tub.

The flat faces 62*b* between the faces 62*a* of collar 62 carry locating members 68. As can be best seen in FIG. 4, each locating member 68 has a downwardly and inwardly inclined outer face 68' arranged to slidably contact an oppositely inclined face 70' forming part of a notch 70 at the upper end of each pin member 20.

Before beginning a coil forming operation, an empty carrier 50 is lowered into the pouring reel tub 12. As the carrier enters the tub, its rotational alignment with respect to the tub components is adjusted so that the ends of the base feet 52 enter and slide down the grooves 58 in the tub side walls 16. As the carrier continues to descend, the truncated conical upper end 24*a* of shaft 24 enters the hollow central hub 50 and thus insures that the carrier is aligned coaxially with the rotatable tub. Finally, as the carrier approaches the lower limit of its descent, the inclined contact faces 68' of the locating members 68 slidably engages the oppositely inclined faces 70' at the upper ends of the pin members 20, thus urging the pin members radially outwardly to their operative positions as shown by the solid lines in FIG. 1. When the carrier's base feet 52 finally land on the tub bottom 14, they are seated in the radial grooves 56, and the locating members 68 are seated in mechanical engagement in the notches 70 at the upper ends of the pin members 20, thus restraining the pin members from further radial expansion.

The pouring reel drive is then energized and the combination of the rotatable tub 12 and carrier 50 is brought up to the desired rotational speed. The mechanical interengagement of the base feet 52 with the groove 56 in the tub bottom 14 and the grooves 58 in the tub side wall 16 insures that the carrier and tub rotate at the same speed. Mill product is then directed by means of a delivery pipe 72 into the coil forming chamber 44 where it accumulates in upstanding coil form as indicated at "C". The inner and outer diameters of the coil are established respectively by the vertical outer edges of the operatively positioned pin members 20, and the cylindrical tub wall 16. The bottom of the coil is supported by the base feet 52 of the carrier 50. The carrier legs 60 remain spaced inwardly from the coil I.D. by a small distance "s" (see FIG. 3) throughout the coil forming operation.

At the end of a coil forming operation, the delivery pipe 72 is cleared from the top end of the reel and the pouring reel drive is de-energized to allow all components to come to rest. The carrier 50 is then lifted out of the pouring reel. As the carrier begins its vertical ascent, the inclined contact faces 68' of the locating members 68 slidably disengage themselves from the oppositely inclined faces 70' on the pin members allowing the pin members to pivot inwardly away from the coil I.D. Thus, even if the coil has begun to shrink as a result of cooling, its I.D. will be free of the pin members and will be safeguarded against scratching or abrasion. While the coil is being cleared from the pouring reel and carried to another location, its bottom continues to be supported on the base feet 52 of the carrier, and its I.D. receives support from the vertically extending core legs 60. Thus, coil distortion is effectively eliminated during both clearing and transit. The space "s" between the core legs 60 and the coil I.D. is adequate to avoid any subsequent binding as the coil cools during transit on the carrier. As soon as a fresh carrier is lowered into the pouring reel, the next coil forming operation can commence.

We claim:

1. Apparatus for forming a longitudinally moving product length into an upstanding cylindrical coil, comprising:

a rotatable tub having a bottom, a cylindrical side wall and a circular row of pin members arranged concentrically within said side wall, said pin members protruding upwardly from said bottom and being pivotal between substantially vertical positions cooperating with said side wall to define an annular chamber, and inoperative positions inclined inwardly away from said side wall;

a carrier removably inserted in said tub and arranged for rotation therewith, said carrier having a base defining the lower end of said chamber with a central core protruding vertically from said base and with locating means for engaging and urging said pin members into their operative positions arranged on said core;

means for rotating the combination of said tub and said carrier while receiving the longitudinally moving mill product in said chamber, thus forming said product into an upstanding coil supported on said base and radially confined between said side wall and said operatively positioned pin members;

said carrier being adapted for vertical removal from said tub following completion of a coil forming operation, with said coil being supported on said base for removal with said carrier, and with said locating means being disengageable from said pin members during carrier removal to thereby permit said pin members to pivot to their inoperative positions.

2. The apparatus of claim 1 wherein said core is spaced radially inwardly from the inner diameter of said annular chamber as defined by said operatively positioned pin members.

3. The apparatus of claim 1 wherein said pin members are pivotally mounted at their lower ends and wherein said locating means is engageable with the upper ends of said pin members.

4. The apparatus of claims 2 or 3 wherein outward pivotal movement of said pin members beyond said operative positions is restrained by said locating means.

5. The apparatus of claim 3 wherein the upper ends of said pin members are provided with inclined faces arranged to be slidably contacted by oppositely inclined faces on said locating means during insertion and removal of said carrier means.

6. The apparatus of claim 1 wherein said base is comprised of feet extending radially from a central hub, said feet being supported on said tub bottom and having their ends received in vertical grooves in the cylindrical side wall of said tub.

7. The apparatus as claimed in claim 6 wherein said central hub is hollow and received axially on a central shaft protruding upwardly from the tub bottom.

8. A pouring reel for a rolling mill, comprising: a rotatable tub having a bottom, an upstanding cylindrical side wall and an open top, with pivotal pin members protruding upwardly from said bottom at locations spaced radially inwardly from said side wall; and, a carrier receivable in said tub through the open top thereof, said carrier having a base arranged to be supported on the tub bottom, a central core protruding upwardly from said base, said locating means on said core, said locating means being operative during receipt of said carrier in said tub to pivotally urge said pin members into radially expanded positions cooperating with the tub side wall to define an annular chamber in which the mill product may be accumulated in coil form on said base, the inner diameter of said chamber and the coil formed therein being larger than the outer diameter of said core, said carrier and said coil being removable from said tub through the open top thereof, with said coil being carried on said base and axially supported by said core, and with said locating means being disengaged from said pin members to thus accommodate radial inward pivotal displacement thereof away from the inner coil diameter.

9. A pouring reel for a rolling mill, comprising: a rotatable tub having a bottom, a side wall extending upwardly from said bottom, and pin members protruding above said bottom at locations spaced radially inwardly from said side wall, said pin members being pivotally movable between radially expanded positions cooperating with said side wall to define an annular coil forming chamber therebetween, and radially collapsed positions spaced radially inwardly from the inner diameter of a coil formed in said chamber; and a carrier having a base, a central core extending upwardly from said base, and locating members carried on said core, said carrier being adapted to be removably received in said tub prior to commencement of a coil forming operation, with said locating members contacting and urging said pin members into their radially expanded positions, with said base underlying said annular chamber to support a coil formed therein, and with said core spaced radially inwardly from the inner diameter of said chamber, whereupon following completion of a coil forming operation, said carrier may be removed from said tub with the completed coil carried on said base and axially supported by said core, the removal of said carrier being accompanied by a separation of said locating members from said pin members, thereby permitting the pin members to pivot to their collapsed positions.

10. The pouring reel of claim 9 wherein said base comprises a plurality of feet extending radially from said central core, and grooves in said side wall for receiving the ends of said feet.

11. The pouring reel of claims 9 or 10 wherein said locating members are arranged to restrain said pin members from radial expansion beyond said radially expanded positions.

* * * * *